US008113698B2

(12) United States Patent
Wu et al.

(10) Patent No.: US 8,113,698 B2
(45) Date of Patent: Feb. 14, 2012

(54) LIGHT-EMITTING DIODE LIGHT BULB AND APPLICATION THEREOF

(75) Inventors: Wen-Liang Wu, Tainan County (TW); Peng-Fang Chen, Tainan County (TW); Yung-Pin Yang, Tainan County (TW)

(73) Assignee: Chi Mei Lighting Technology Corp., Tainan County (TW)

( * ) Notice: Subject to any disclaimer, the term of this patent is extended or adjusted under 35 U.S.C. 154(b) by 182 days.

(21) Appl. No.: 12/536,511

(22) Filed: Aug. 6, 2009

(65) Prior Publication Data

US 2010/0238672 A1 Sep. 23, 2010

(30) Foreign Application Priority Data

Mar. 20, 2009 (TW) ..... 98109288 A

(51) Int. Cl.
*F21V 29/00* (2006.01)

(52) U.S. Cl. ..... 362/373; 362/294; 362/249.02; 362/249.09; 362/270; 362/287

(58) Field of Classification Search ..... 362/294, 362/373, 249.02, 249.09, 270, 287
See application file for complete search history.

(56) References Cited

U.S. PATENT DOCUMENTS

| | | | | |
|---|---|---|---|---|
| 4,727,289 | A * | 2/1988 | Uchida | 315/71 |
| 6,220,722 | B1 * | 4/2001 | Begemann | 362/231 |
| 6,461,008 | B1 * | 10/2002 | Pederson | 362/35 |
| 7,425,082 | B1 * | 9/2008 | Jones | 362/285 |
| 7,976,211 | B2 * | 7/2011 | Cao | 362/650 |
| 2006/0181880 | A1 | 8/2006 | Gordin et al. | |

FOREIGN PATENT DOCUMENTS

| | | | |
|---|---|---|---|
| CN | 1912458 | A | 2/2007 |
| CN | 101363607 | A | 2/2009 |
| CN | 101368702 | A | 2/2009 |
| JP | 62-30386 | A | 2/1987 |
| JP | 2007-12288 | | 1/2007 |
| TW | M345199 | | 11/2008 |

* cited by examiner

*Primary Examiner* — Stephen F Husar
*Assistant Examiner* — James Cranson, Jr.
(74) *Attorney, Agent, or Firm* — CKC & Partners Co., Ltd.

(57) ABSTRACT

A light-emitting diode (LED) light bulb and an application thereof are described. The light-emitting diode light bulb comprises: a light-emitting diode light source module; a base, wherein the light-emitting diode light source module is disposed on the base; and a driver portion to drive the light-emitting diode light source module, comprising a rotation shaft, wherein the driver portion is connected to the base via the rotation shaft, such that the light-emitting diode light source module can rotate relative to the driver portion.

18 Claims, 9 Drawing Sheets

LIGHT-EMITTING DIODE LIGHT BULB AND APPLICATION THEREOF

RELATED APPLICATIONS

This application claims priority to Taiwan Application Serial Number 98109288, filed Mar. 20, 2009, which is herein incorporated by reference.

FIELD OF THE INVENTION

The present invention relates to an illumination device, and more particularly to a light-emitting diode (LED) light bulb and its application on a light-emitting diode illumination device.

BACKGROUND OF THE INVENTION

Refer to FIG. 1. FIG. 1 is a three-dimensional diagram of a conventional light-emitting diode illumination device. A light-emitting diode illumination device 100 comprises a light fixture 102 and a typical light-emitting diode light bulb 112. The light-emitting diode light bulb 112 includes a driver portion 104, a base 106, a light-emitting diode light plate 108 and a lamp cover 110. The light-emitting diode light plate 108 is disposed on the base 106, the base 106 along with the light-emitting diode light plate 108 set thereon are disposed on the driver portion 104, and the lamp cover 110 covers the light-emitting diode light plate 108. The light-emitting diode light plate 108 includes a circuit board 116 and a plurality of light-emitting diodes 114, wherein the light-emitting diodes 114 are disposed on the circuit board 116 and are electrically connected to the driver portion 104. By disposing the driver portion 104 of the light-emitting diode light bulb 112 on the light fixture 102, the light-emitting diode light bulb 112 can be assembled in the light fixture 102 to complete the fabrication of the light-emitting diode illumination device 100.

The light fixture 102 is a direct type light fixture, i.e. the illumination direction is from top to bottom. Therefore, when the light-emitting diode light bulb 112 is assembled in the direct type light fixture 102, light of the light-emitting diode light bulb 112 is emitted from top to bottom as the illumination direction of a direct type light fixture, so that the illumination of the light-emitting diode illumination device 100 is not affected.

Refer to FIG. 2. FIG. 2 is a three-dimensional diagram of another conventional light-emitting diode illumination device. A light-emitting diode illumination device 100*a* comprises a light fixture 102*a* and the light-emitting diode light bulb 112. In the conventional light-emitting diode illumination device 100*a*, the light-emitting diode light bulb 112 is used to replace a fluorescent bulb in another conventional fluorescent light fixture. The light-emitting diode illumination devices 100*a* and 100 use the same light-emitting diode light bulb 112. The difference between the light-emitting diode illumination devices 100 and 100*a* is that the light fixture 102*a* is a lateral type light fixture, i.e. a connection socket 118 of the light fixture 102*a* extends laterally from an inner side surface of the light fixture 102*a*. The light fixtures shown in FIGS. 1 and 2 are recessed lamps, for example.

When the light-emitting diode light bulb 112 is assembled, the driver portion 104 of the light-emitting diode light bulb 112 is installed into the connection socket 118 on the inner side surface of the light fixture 102*a*. At present, the light-emitting diode light bulb 112 is laterally disposed in the light fixture 102*a*, and the light-emitting diodes 114 (refer to FIG. 1) on a front end of the light-emitting diode light bulb 112 face the inner side surface of the light fixture 102*a*. The illumination direction of the light-emitting diodes 114 has directivity, so that the light emitted by the light-emitting diodes 114 projects onto the inner side surface of the light fixture 102*a*. Accordingly, the light emitted by the light-emitting diode light bulb 112 cannot be fully reflected downward, thereby greatly reducing the illumination of the light-emitting diode illumination device 100*a*.

Therefore, in the current light-emitting diode light bulb, the illumination direction of the light-emitting diodes has directivity, so that the light-emitting diode light bulb only can be applied in a direct type light fixture and cannot be applied in a lateral type light fixture.

SUMMARY OF THE INVENTION

Therefore, one aspect of the present invention is to provide a light-emitting diode light bulb and a light-emitting diode illumination device including the same, in which a base carrying a light-emitting diode light source module is connected to a driver portion via a rotation shaft, so that the light-emitting diode light source module can rotate relative to the driver portion. As a result, the illumination direction of the light-emitting diode light bulb is not limited by the light fixture, and the application of the light-emitting diode light bulb can be broadened.

Another aspect of the present invention is to provide a light-emitting diode light bulb and a light-emitting diode illumination device including the same, which can adjust the location of a light-emitting diode light source module in relation of a driver portion according to the light fixture, so that the light-emitting diode light bulb can be applied in a direct type or a lateral type light fixture.

According to the aforementioned aspects, the present invention provides a light-emitting diode light bulb, comprising: a light-emitting diode light source module; a base, wherein the light-emitting diode light source module is disposed on the base; and a driver portion to drive the light-emitting diode light source module, comprising a rotation shaft, wherein the driver portion is connected to the base via the rotation shaft, such that the light-emitting diode light source module can rotate relative to the driver portion.

According to one embodiment of the present invention, the driver portion further comprises a fixed sleeve and a sliding sleeve slidably disposed within the fixed sleeve.

According to another embodiment of the present invention, a rotation groove is set and passes through the base, and the fixed sleeve and the sliding sleeve can rotate in the rotation groove via the rotation shaft.

According to the aforementioned aspects, the present invention further provides a light-emitting diode illumination device, comprising: a light fixture including a connection socket; and a light-emitting diode light bulb comprising: a light-emitting diode light source module; a base, wherein the light-emitting diode light source module is disposed on the base; and a driver portion being assembled to the connection socket, wherein the driver portion comprises a rotation shaft, and the driver portion is connected to the base via the rotation shaft, such that the light-emitting diode light source module can rotate relative to the driver portion.

According to one embodiment of the present invention, the connection socket laterally extends from an inner side surface of the light fixture, and the driver portion of the light-emitting diode light bulb is located on an outer side surface of the base.

According to another embodiment of the present invention, the connection socket is located on a top surface of the light fixture, and the driver portion of the light-emitting diode light bulb is located on a rear end of the base.

BRIEF DESCRIPTION OF THE DRAWINGS

The foregoing aspects and many of the attendant advantages of this invention are more readily appreciated as the same become better understood by reference to the following detailed description, when taken in conjunction with the accompanying drawings, wherein.

DETAILED DESCRIPTION OF THE PREFERRED EMBODIMENTS

Figure 1:
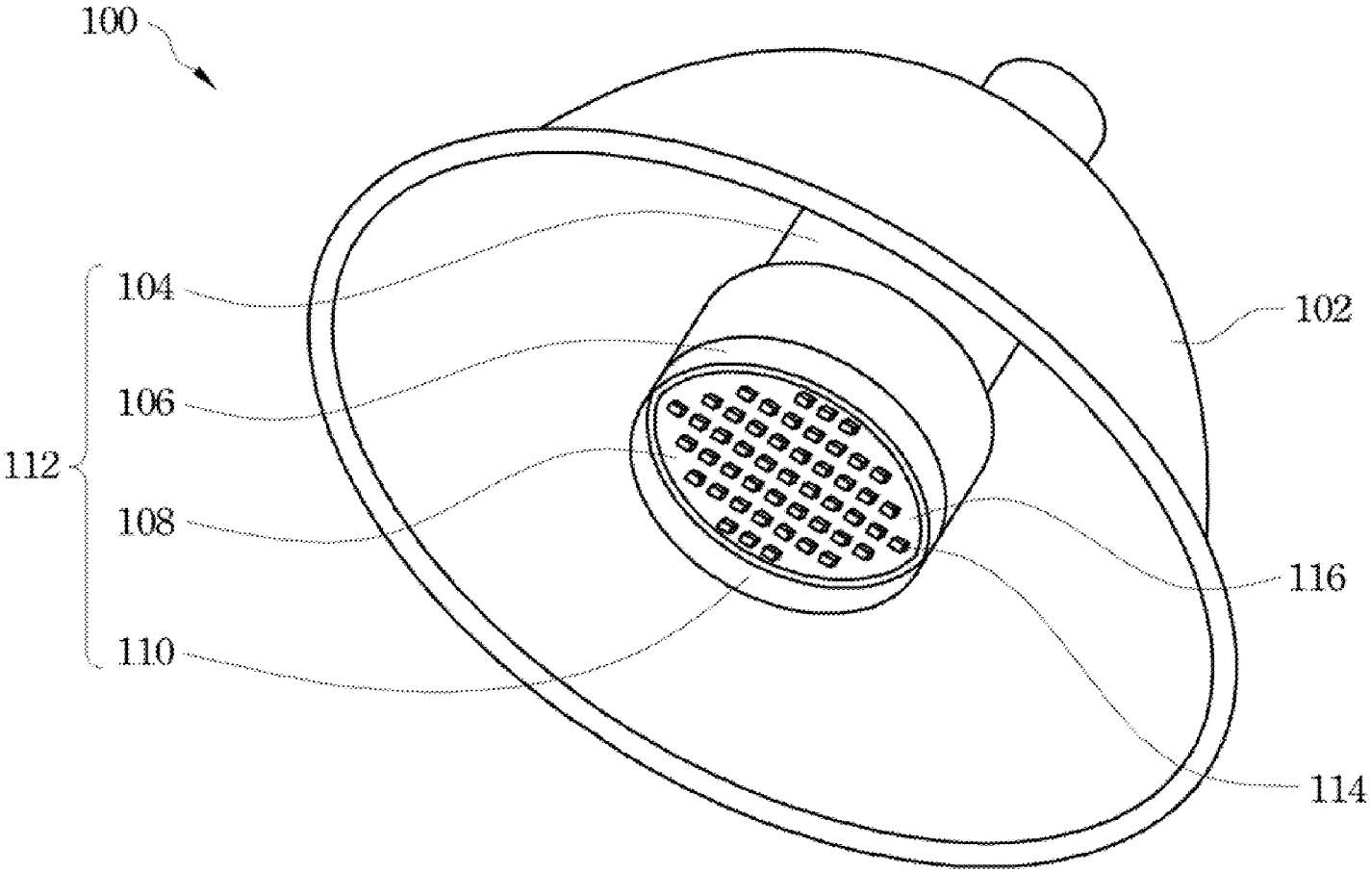
FIG. 1 (PRIOR ART)
FIG. 1 is a three-dimensional diagram of a conventional light-emitting diode illumination device.
Figure 2:
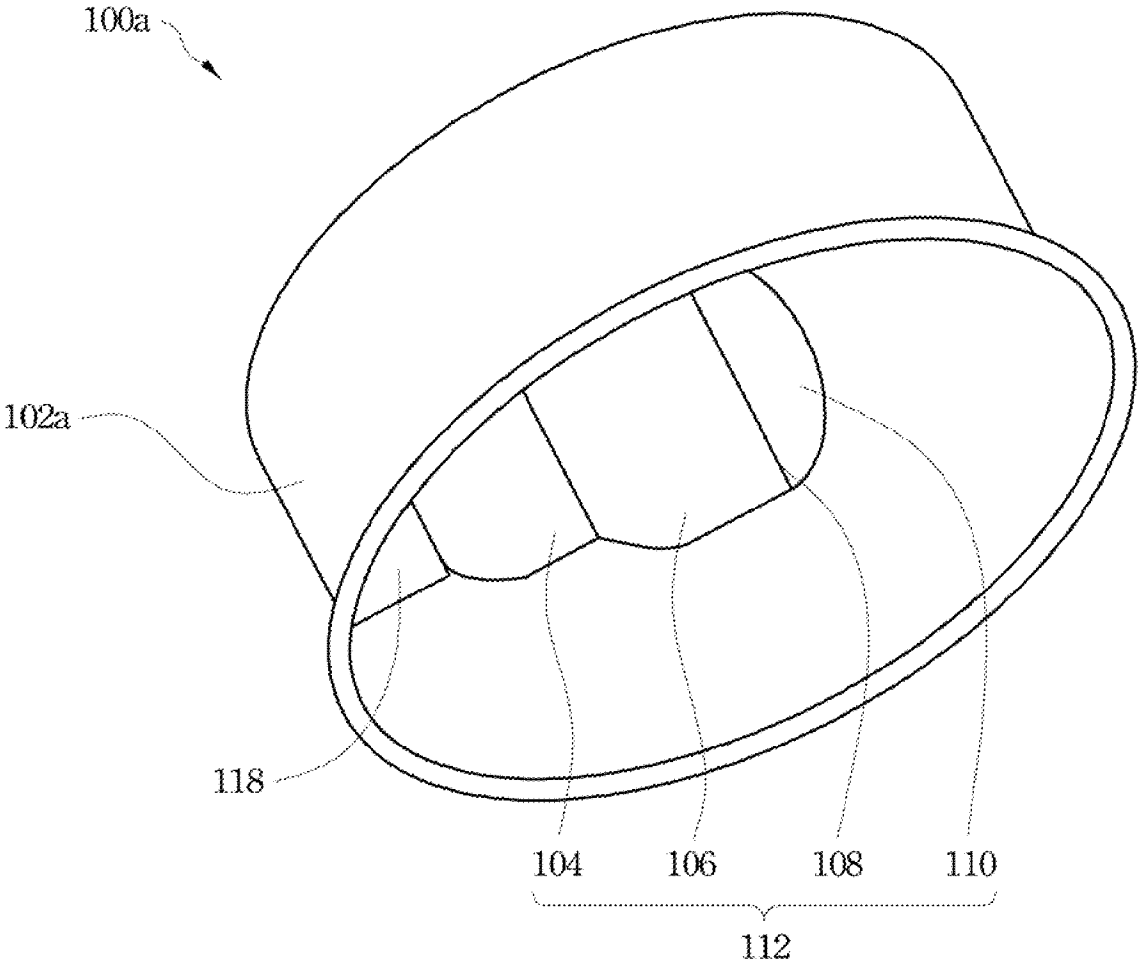
FIG. 2 (PRIOR ART)
FIG. 2 is a three-dimensional diagram of another conventional light-emitting diode illumination device.
Figure 3:
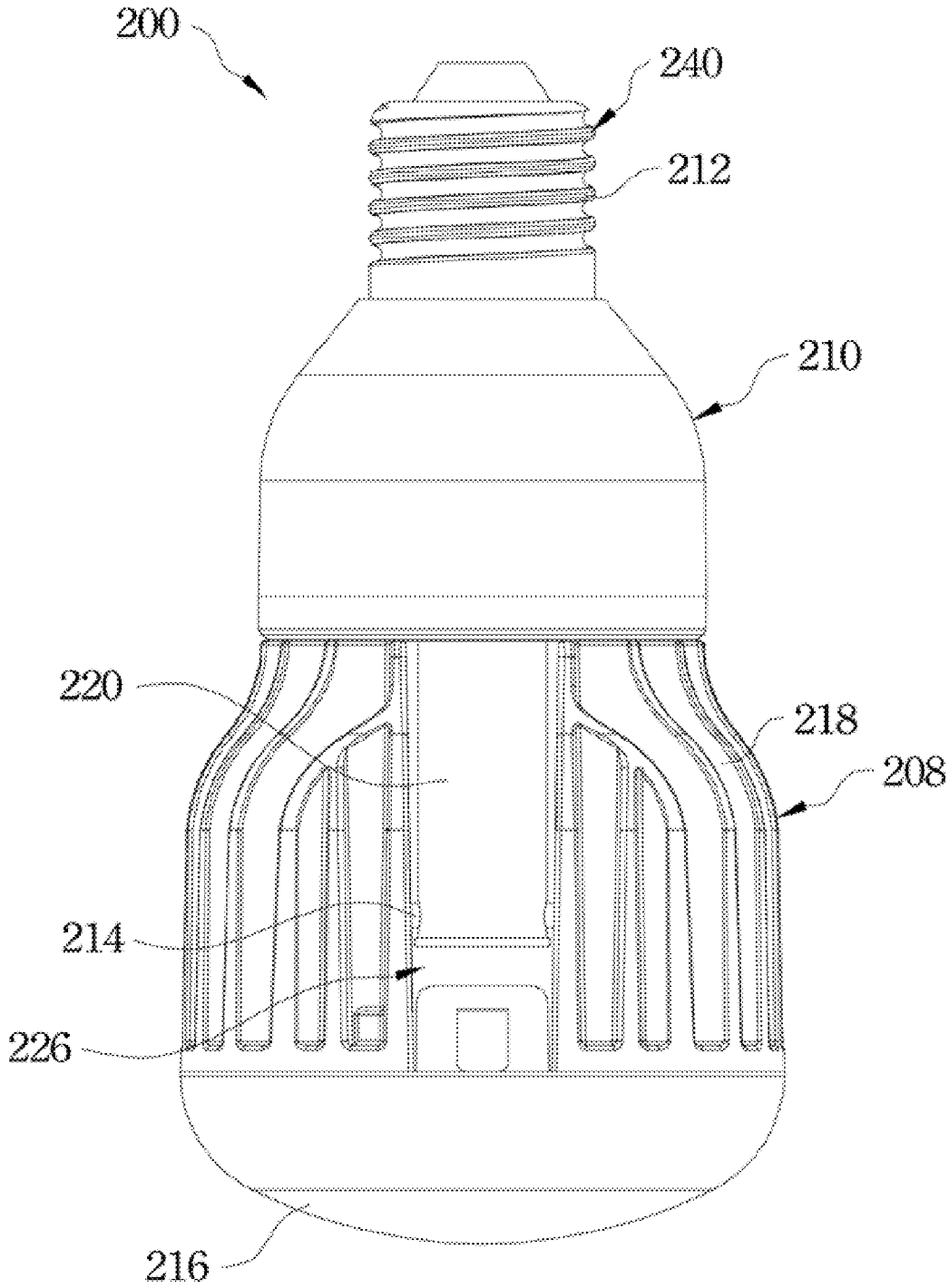
FIG. 3 illustrates a lateral view of a light-emitting diode light bulb in accordance with one embodiment of the present invention.
Figure 4:
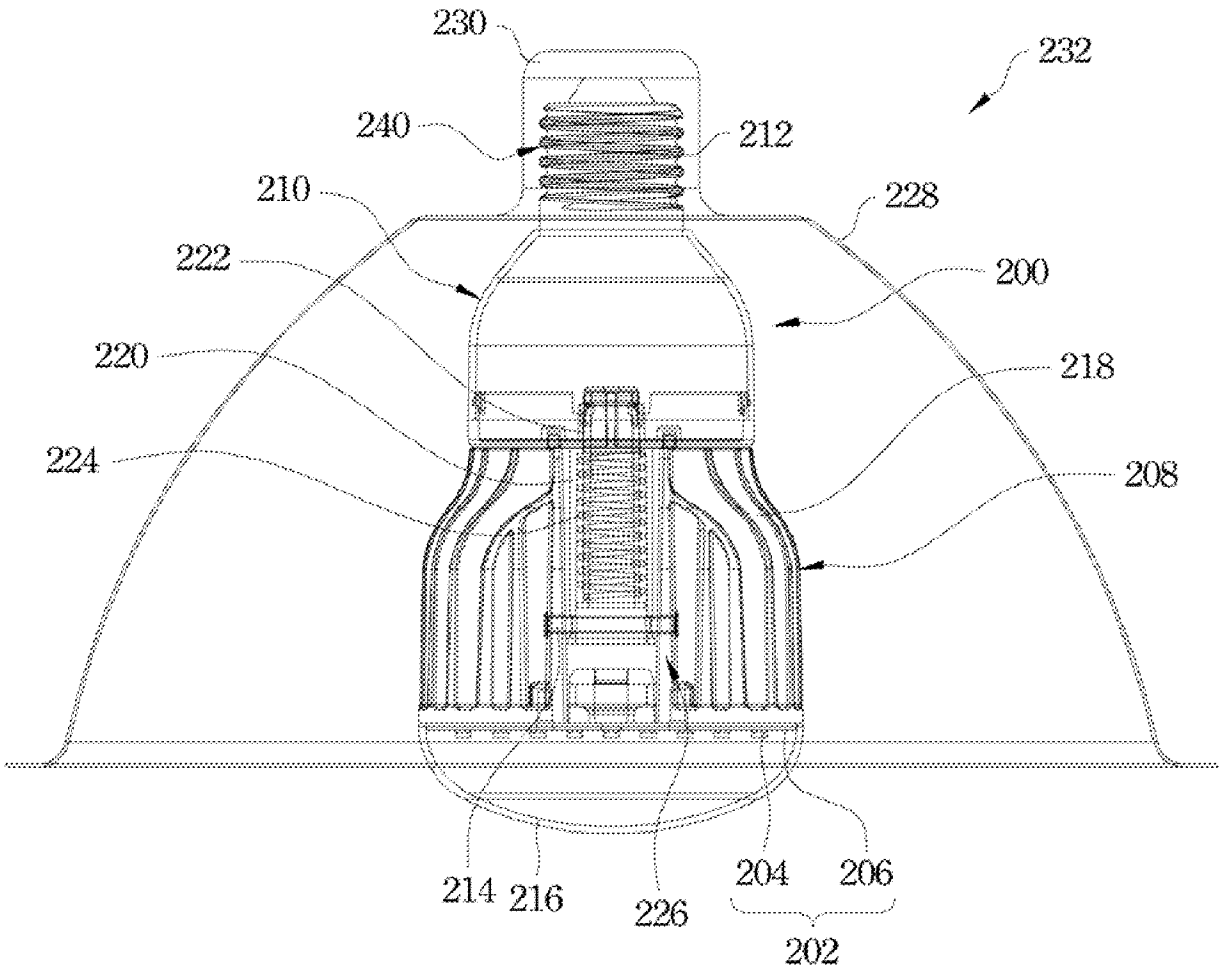
FIG. 4 is a perspective drawing of a light-emitting diode illumination device in accordance with one embodiment of the present invention.

Refer to FIGS. 3 and 4. FIG. 3 illustrates a lateral view of a light-emitting diode light bulb in accordance with one embodiment of the present invention, and FIG. 4 is a perspective drawing of a light-emitting diode illumination device in accordance with one embodiment of the present invention. In the present embodiment, a light-emitting diode light bulb 200 mainly comprises a light-emitting diode light source module 202, a base 208 and a driver portion 210, such as shown in FIG. 4. The light-emitting diode light source module 202 mainly comprises a circuit board 206 and a plurality of light-emitting diodes 204. The circuit board 206 may be preset with a desired circuit, and the light-emitting diodes 204 are disposed on the circuit board 206 and are electrically connected to the preset circuit on the circuit board 206.

The light-emitting diode light source module 202 is disposed on the base 208 and is carried by the base 208. In one embodiment, such as shown in FIG. 3, according to the product requirement, the base 208 may further comprise a heat sink 218, wherein the heat sink 218 may, for example, include a plurality of heat dissipating fins to facilitate the dissipating of the heat produced by the light-emitting diode light source module 202 during operation, so as to achieve the objectives of enhancing the luminous efficiency of the light-emitting diode light source module 202 and prolonging the lifetime of the light-emitting diode light source module 202. In one exemplary embodiment, the light-emitting diode light bulb 200 may selectively include a lamp cover 216 covering the light-emitting diode light source module 202. In addition to protecting the light-emitting diode light source module 202, the lamp cover 216 may be used to adjust the optical effects, such as a diffusion effect, according to the product requirements.

The driver portion 210 is mainly used to drive the light-emitting diode light source module 202. The driver portion 210 comprises a rotation shaft 214, and the driver portion 210 can be connected to the base 208 via the rotation shaft 214, such as shown in FIGS. 3 and 4. In the light-emitting diode light bulb 200 illustrated in FIG. 3, the driver portion 210 is located on a rear end of the base 208. The driver portion 210 may usually include a power connection port 212, wherein the power connection port 212 can be electrically connected to an external power source to provide the light-emitting diode light source module 202 with the power. In one exemplary embodiment, the power connection port 212 of the driver portion 210 may include a connection structure, such as a thread structure 240 illustrated in FIG. 3, to facilitate the connection of the power connection port 212 and the light fixture.

Refer to FIG. 4. A light-emitting diode illumination device 232 mainly comprises the above-mentioned light-emitting diode light bulb 200 and a light fixture 228. In one exemplary embodiment, the light-emitting diode illumination device 232 may be, for example, a recessed lamp. The light fixture 228 comprises a connection socket 230, wherein the connection socket 230 may be located on a top surface of the light fixture 228. The connection socket 230 of the light fixture 228 may be set with a connection structure (not shown) corresponding to the connection structure of the power connection port 212 of the driver portion 210 of the light-emitting diode light bulb 200. For example, the power connection port 212 of the driver portion 210 has the thread structure 240, so that an inner side surface of the connection socket 230 of the light fixture 228 may be set with a corresponding thread structure. Therefore, by rotating and locking the power connection port 212 in the connection socket 230 of the light fixture 228, the light-emitting diode light bulb 200 can be assembled in the light fixture 228 to form the light-emitting diode illumination device 232. It is worthy of note that the connection method between the power connection port 212 of the driver portion 210 and the connection socket 230 of the light fixture 228 can be replaced by the other methods, such as a jamming connection method, and is not limited to the above-mentioned embodiments.

Such as shown in FIG. 4, in the light-emitting diode illumination device 232, the light fixture 228 is a direct type light fixture, and the driver portion 210 of the light-emitting diode light bulb 200 is located on the rear end of the base 208. Therefore, after the light-emitting diode light bulb 200 is assembled in the light fixture 228, the light-emitting directions of the light-emitting diodes 204 of the light-emitting diode light source module 202 of the light-emitting diode light bulb 200 are from top to down, so that the light emitted by the light-emitting diode light bulb 200 can be fully projected downward, and the light-emitting diode illumination device 232 can obtain the predetermined illumination.

In the present embodiment, referring to FIGS. 3 and 4 again, the driver portion 210 of the light-emitting diode light bulb 200 may further include a fixed sleeve 220 and a sliding sleeve 222 selectively. The sliding sleeve 222 is slidably disposed within the fixed sleeve 220. In the light-emitting diode light bulb 200, the rotation shaft 214 of the driver portion 210 passes through one end of the fixed sleeve 220, and the sliding sleeve 222 is disposed within the fixed sleeve 220, so that the fixed sleeve 220 and the sliding sleeve 222 can be integrated with the base 208 via the rotation shaft 214. In one embodiment, the driver portion 210 of the light-emitting diode light bulb 200 may further selectively include an elastic element 224, such as a spring or an elastic washer. The elastic element 224 is set around an outer side surface of the sliding sleeve 222 and is located between the fixed sleeve 220 and the sliding sleeve 222 to provide elasticity to facilitate the combination and the positioning of the driver portion 210 and the base 208.

In the present embodiment, according to the design of the fixed sleeve 220 and the sliding sleeve 222 of the driver portion 210, the base 208 of the light-emitting diode light bulb 200 may be further set with a rotation groove 226. The rotation groove 226 may pass through the base 208, the rotation shaft 214 of the driver portion 210 spans and is fixed inside the rotation groove 226 of the base 208, and the fixed sleeve 220 and the sliding sleeve 222 are also located inside the rotation groove 226. With the rotation shaft 214, the fixed sleeve 220 and the sliding sleeve 222 can rotate in the rotation groove 226 of the base 208, such that the light-emitting diode light source module 202 carried by the base 208 can rotate relative to the driver portion 210.

Accordingly, in the light-emitting diode light bulb 200 of the present embodiment, the location of the light-emitting diode light source module 202 in relation of the driver portion 210 can be adjusted by rotating according to various light fixtures.

Figure 5:
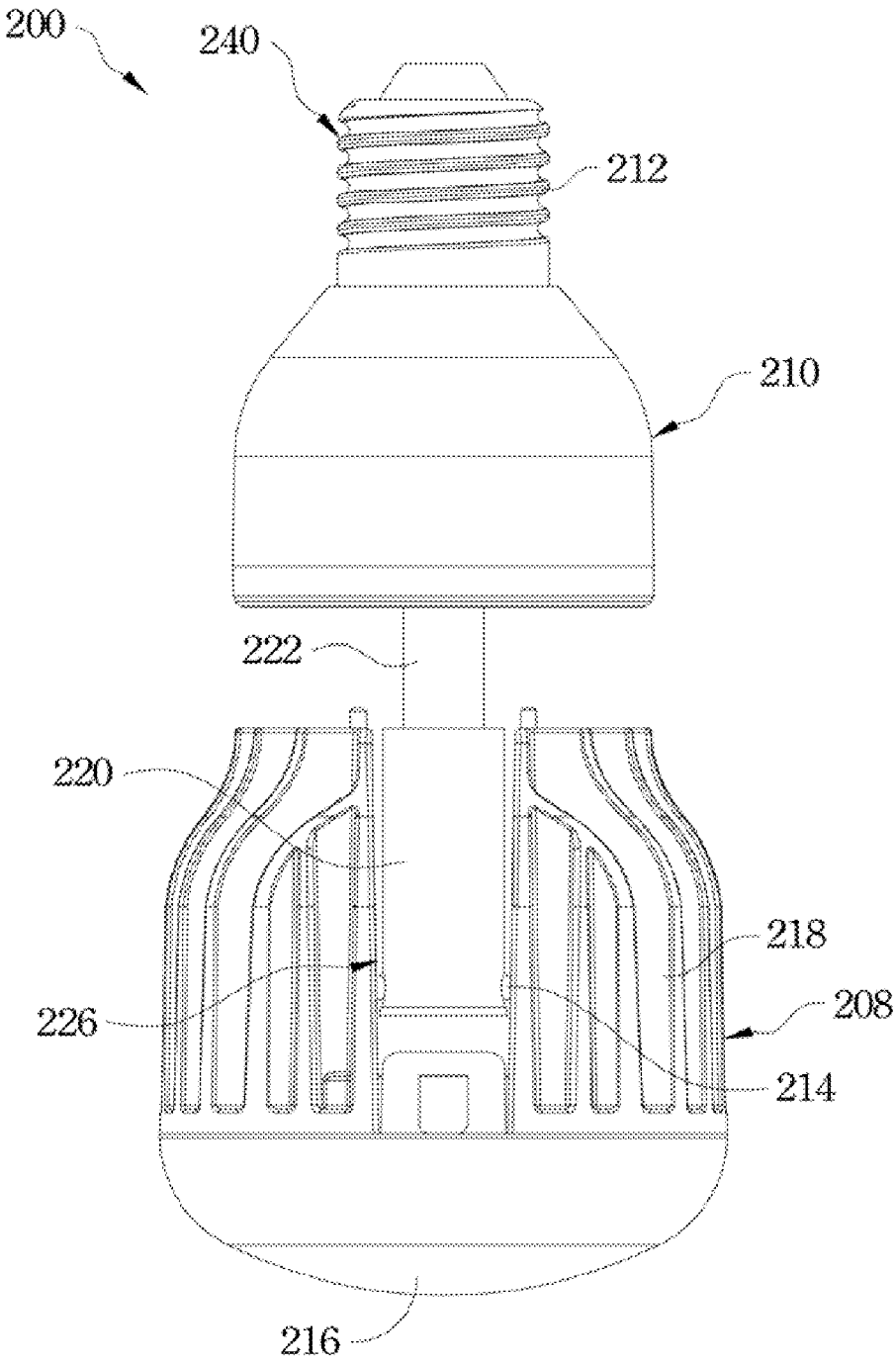
FIG. 5 is a three-dimensional drawing of a light-emitting diode light bulb while being pulled apart in accordance with one embodiment of the present invention.
Figure 6:
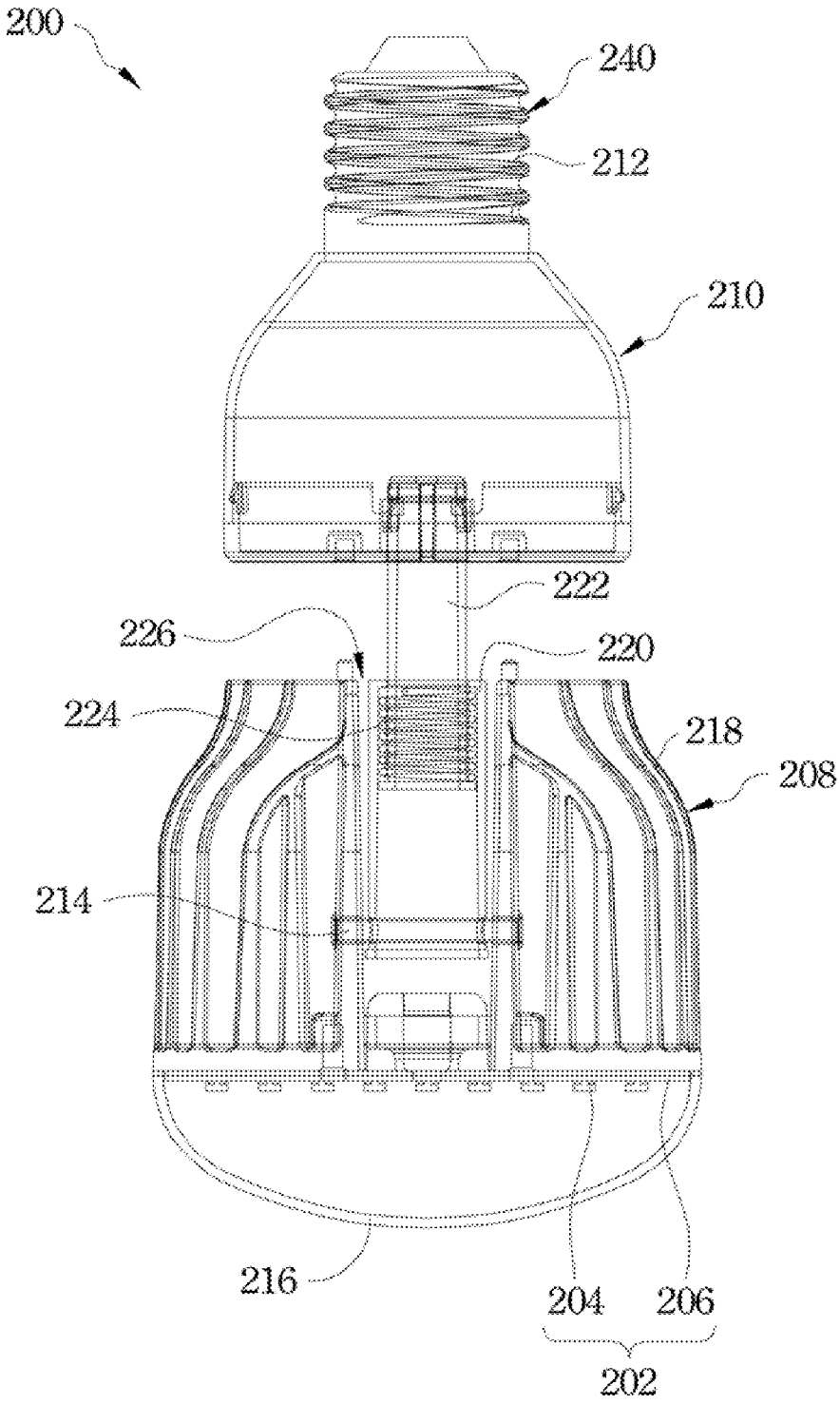
FIG. 6 is a perspective drawing of a light-emitting diode light bulb while being pulled apart in accordance with one embodiment of the present invention.

Simultaneously refer to FIGS. 5 and 6. FIGS. 5 and 6 are respectively a three-dimensional drawing and a perspective drawing of a light-emitting diode light bulb while being pulled apart in accordance with one embodiment of the present invention. With the design of the fixed sleeve 220 and the sliding sleeve 222 of the driver portion 210, the light-emitting diode light bulb 200 can be pulled apart between the base 208 and the driver portion 210 to make a distance form between the driver portion 210 and the base 208, such as shown in FIG. 5. At present, such as shown in FIG. 6, the sliding sleeve 222 slides outwardly from the fixed sleeve 220 and compresses the elastic element 224.

Figure 7:
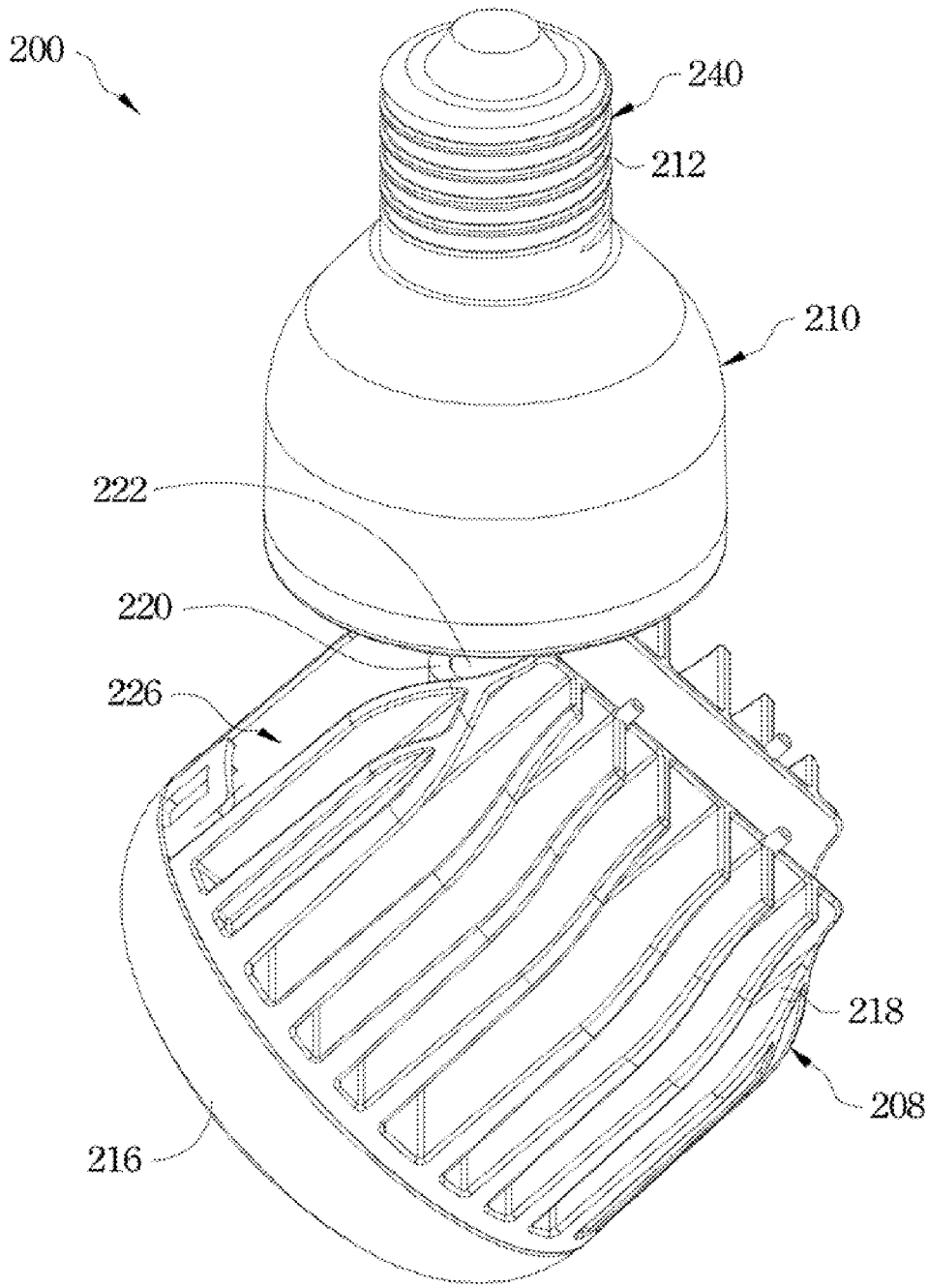
FIG. 7 is a three-dimensional drawing of a light-emitting diode light bulb while rotating in accordance with one embodiment of the present invention.
Figure 8:
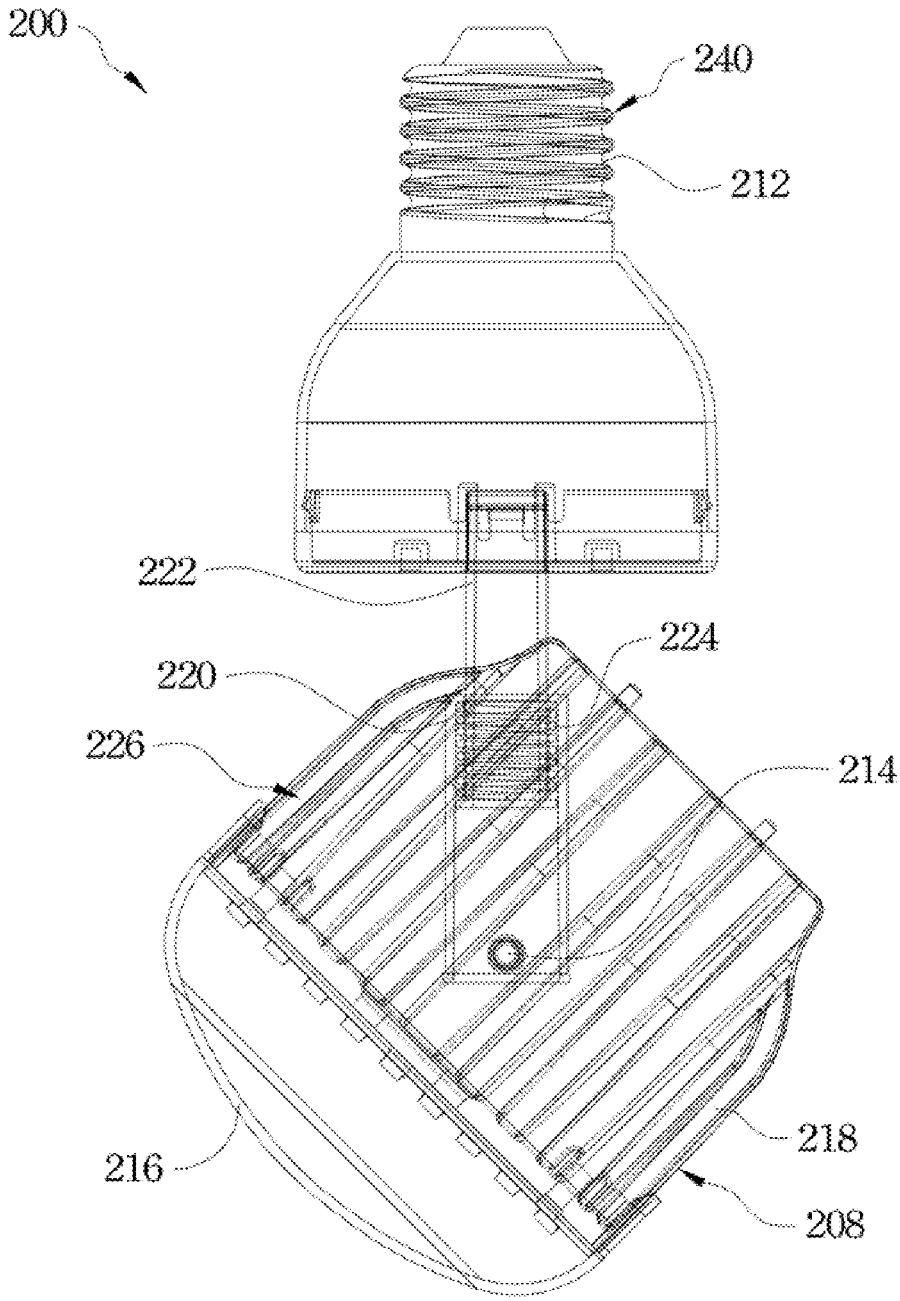
FIG. 8 is a perspective drawing of a light-emitting diode light bulb while rotating in accordance with one embodiment of the present invention.
Figure 9:
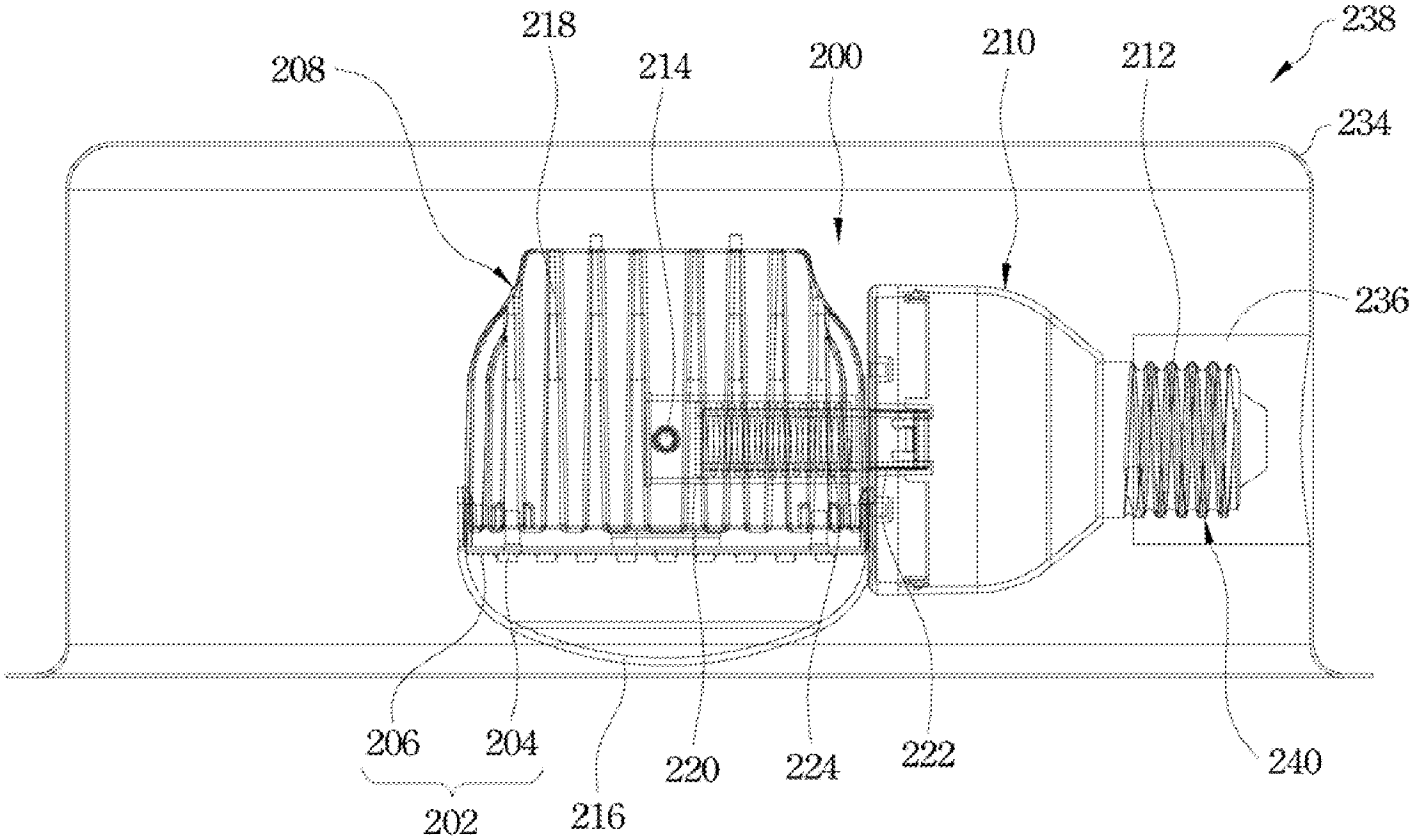
FIG. 9 is a perspective drawing of another light-emitting diode illumination device in accordance with one embodiment of the present invention.

Simultaneously refer to FIGS. 7 and 8. FIGS. 7 and 8 are respectively a three-dimensional drawing and a perspective drawing of a light-emitting diode light bulb while rotating in accordance with one embodiment of the present invention. After the base 208 and the driver portion 210 of the light-emitting diode light bulb 200 are pulled apart, the driver portion 210 and the base 208 can be relatively rotated by using the rotation shaft 214 as a rotation axis, such as shown in FIGS. 7 and 8. Then, the driver portion 210 of the light-emitting diode light bulb 200 can be rotated to a side surface of the base 208. Then, with the reverberated elasticity of the elastic element 224 between fixed sleeve 220 and the sliding sleeve 222 of the driver portion 210, the sliding sleeve 222 can be pulled back toward the fixed sleeve 220 to make the driver portion 210 be against and positioned on the outer side surface of the base 208, such as shown in FIG. 9.

Thus, the current light-emitting diode light bulb 200 can be assembled in a lateral type light fixture. Referring to FIG. 9 again, in a light-emitting diode illumination device 238, a light fixture 234 is a lateral type light fixture, and a connection socket 236 of the light fixture 234 laterally extends from an inner side surface of the light fixture 234. Therefore, when the current light-emitting diode light bulb 200 is assembled in the light fixture 234, the light-emitting direction of the light-emitting diodes 204 of the light-emitting diode light source module 202 disposed on the front end of the base 208 is from top to bottom and is not toward the inner side surface of the light fixture 234 after the power connection port 212 of the driver portion 210 of the light-emitting diode light bulb 200 is installed in the connection socket 236 of the light fixture 234. Accordingly, after the current light-emitting diode light bulb 200 is assembled in the lateral type light fixture 234, the light-emitting diode light source module 202 of the light-emitting diode light bulb 200 can fully exhibit its illumination and is not affected by the light fixture 234. In one exemplary embodiment, the light-emitting diode illumination device 238 may be, for example, a recessed lamp.

According to the aforementioned embodiments, one advantage of the present invention is that in a light-emitting diode light bulb of the present invention, a base carrying a light-emitting diode light source module is connected to a driver portion via a rotation shaft, so that the light-emitting diode light source module can rotate relative to the driver portion. Therefore, the illumination direction of the light-emitting diode light bulb is not limited by the light fixture, so that the application of the light-emitting diode light bulb can be broadened.

According to the aforementioned embodiments, another advantage of the present invention is that a light-emitting diode light bulb of the present invention can adjust the location of a light-emitting diode light source module in relation of a driver portion according to the light fixture, so that the light-emitting diode light bulb can be applied in a direct type or a lateral type light fixture.

As is understood by a person skilled in the art, the foregoing preferred embodiments of the present invention are illustrative of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. A light-emitting diode light bulb, comprising:

a light-emitting diode light source module;

a base, wherein the light-emitting diode light source module is disposed on the base; and a driver portion to drive the light-emitting diode light source module, comprising a rotation shaft, a fixed sleeve and a sliding sleeve, wherein the driver portion is connected to the base via the rotation shaft, such that the light-emitting diode light source module can rotate relative to the driver portion, and sliding sleeve is slidably disposed within the fixed sleeve.

2. The light-emitting diode light bulb according to claim 1, wherein the base further comprises a heat sink.

3. The light-emitting diode light bulb according to claim 2, wherein the heat sink comprises a plurality of heat dissipating fins.

4. The light-emitting diode light bulb according to claim 1, wherein a rotation groove is set and passes through the base, and the fixed sleeve and the sliding sleeve can rotate in the rotation groove via the rotation shaft.

5. The light-emitting diode light bulb according to claim 1, wherein the driver portion further comprises an elastic element disposed in the fixed sleeve and between the fixed sleeve and the sliding sleeve.

6. The light-emitting diode light bulb according to claim 1, wherein the driver portion further comprises a power connection port used to connect with a light fixture.

7. The light-emitting diode light bulb according to claim 1, further comprising a lamp cover covering the light-emitting diode light source module.

8. A light-emitting diode illumination device, comprising:

a light fixture including a connection socket; and a light-emitting diode light bulb comprising:

a light-emitting diode light source module;

a base, wherein the light-emitting diode light source module is disposed on the base; and a driver portion being assembled to the connection socket, wherein the driver portion comprises a rotation shaft, and the driver portion is connected to the base via the rotation shaft, such that the light-emitting diode light source module can rotate relative to the driver portion.

9. The light-emitting diode illumination device according to claim 8, wherein the base further comprises a heat sink.

10. The light-emitting diode illumination device according to claim 9, wherein the heat sink comprises a plurality of heat dissipating fins.

11. The light-emitting diode illumination device according to claim 8, wherein the driver portion further comprises a fixed sleeve and a sliding sleeve slidably disposed within the fixed sleeve.

12. The light-emitting diode illumination device according to claim 11, wherein a rotation groove is set and passes through the base, and the fixed sleeve and the sliding sleeve can rotate in the rotation groove via the rotation shaft.

13. The light-emitting diode illumination device according to claim 11, wherein the driver portion further comprises an elastic element disposed in the fixed sleeve and between the fixed sleeve and the sliding sleeve.

14. The light-emitting diode illumination device according to claim 8, wherein the driver portion further comprises a power connection port connecting with the connection socket.

15. The light-emitting diode illumination device according to claim 8, wherein the light-emitting diode light bulb further comprises a lamp cover covering the light-emitting diode light source module.

16. The light-emitting diode illumination device according to claim 8, wherein the light-emitting diode illumination device is a recessed lamp.

17. The light-emitting diode illumination device according to claim 8, wherein the connection socket laterally extends from an inner side surface of the light fixture, and the driver portion is located on an outer side surface of the base.

18. The light-emitting diode illumination device according to claim 8, wherein the connection socket is located on a top surface of the light fixture, and the driver portion is located on a rear end of the base.

* * * * *